United States Patent [19]

Antonious

[11] Patent Number: 4,458,900

[45] **Date of Patent: * Jul. 10, 1984**

[54] GOLF CLUB ALIGNMENT SYSTEM

[76] Inventor: Anthony J. Antonious, 205 E. Joppa Rd., Towson, Md. 21204

[ * ] Notice: The portion of the term of this patent subsequent to Jan. 30, 1996 has been disclaimed.

[21] Appl. No.: 952,103

[22] Filed: Oct. 17, 1978

Related U.S. Application Data

[63] Continuation-in-part of Ser. No. 761,860, Jan. 24, 1977, Pat. No. 4,136,877, which is a continuation-in-part of Ser. No. 649,897, Jan. 16, 1976, abandoned.

[51] Int. Cl.[3] ..... A63B 53/04; A63B 69/36

[52] U.S. Cl. ..... 273/164; 273/183 D

[58] Field of Search ..... 273/183 D, 183 E, 186 A, 273/163 R, 163 A, 164; 33/292, 261, 289, 297, 174 F, 234

[56] References Cited

U.S. PATENT DOCUMENTS

| | | | |
|---|---|---|---|
| 1,556,062 | 10/1925 | Baugh | 273/163 R X |
| 2,380,501 | 7/1945 | Christian et al. | 33/234 X |
| 3,019,022 | 1/1962 | Ehmke | 273/163 R |
| 3,548,504 | 12/1970 | Sykes | 273/183 E |
| 3,880,430 | 4/1975 | McCabe | 273/164 X |
| 4,032,156 | 6/1977 | Clarke | 273/164 |
| 4,136,877 | 1/1979 | Antonious | 273/183 D X |

*Primary Examiner*—George J. Marlo
*Attorney, Agent, or Firm*—Nicholas J. Aquilino

[57] ABSTRACT

A complete system of alignment indicia for a golf club to provide the user with precise alignment for both loft and lie indicating when the club is properly soled including intersecting, inner indicia having four point, three point and two point alignment, adjoining inner indicia having three point and two point alignment, non-touching inner indicia having four point, three point and two point alignment and a combination of outer geometric marks which are complementary to and aligned with the various other geometric designs in four point, three point and two point alignment arrangements. This alignment system provides at least one of the inner directional indicia parallel to the ball striking face and a second of the inner indicia being perpendicular to the ball striking face and complementary outer indicia in the same direction whereby the inner indicia extend outwardly to interface with the outer indicia creating a visual inline, outwardly radiating extension of the dominant central image which appears as one enlarged image when the inner and outer indicia are interfaced to clearly present a single sighting image at a single focal point on the golf club.

5 Claims, 20 Drawing Figures

FIG. 1.
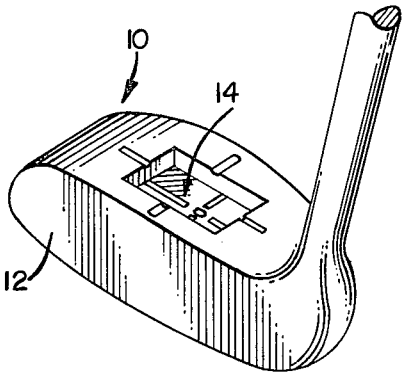
FIG. 3.
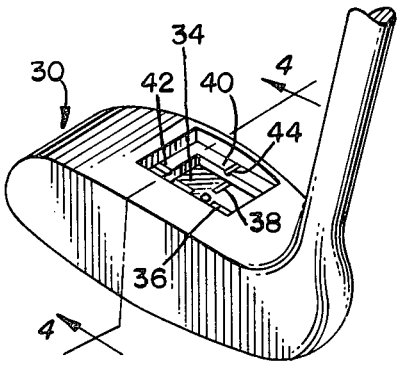
FIG. 4.
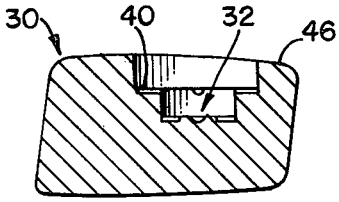
FIG. 5.
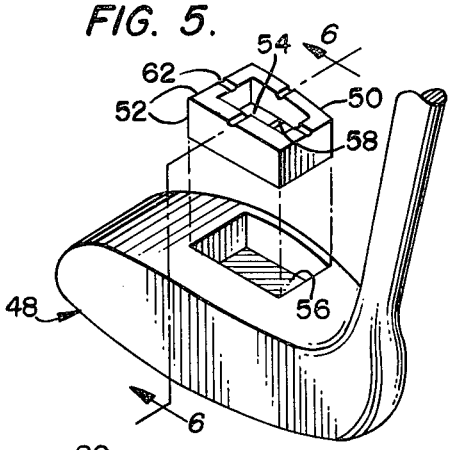
FIG. 2.
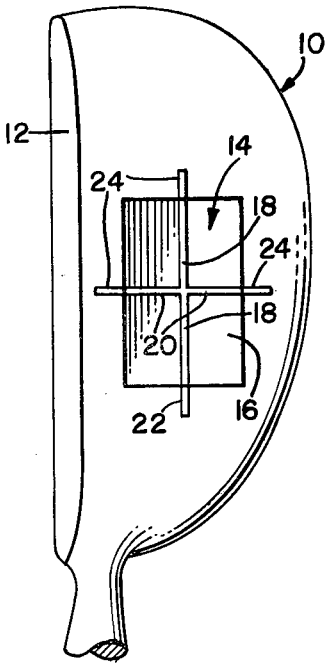
FIG. 6.
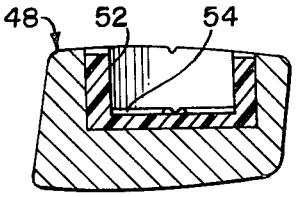
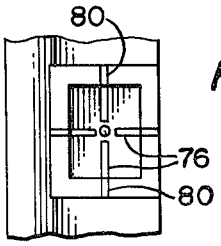
FIG. 8.
FIG. 9.
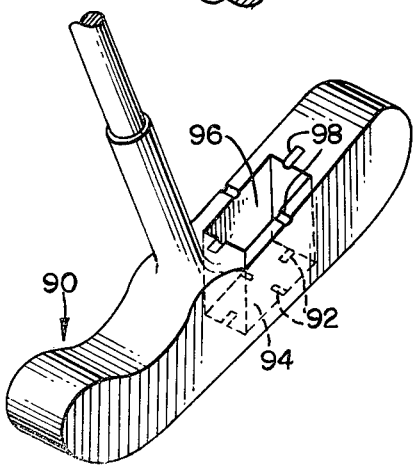
FIG. 7.
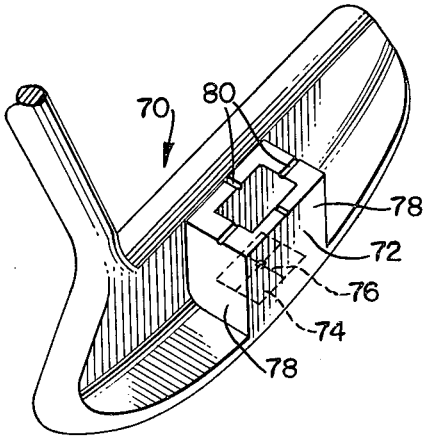

GOLF CLUB ALIGNMENT SYSTEM

CROSS REFERENCE TO RELATED APPLICATIONS

This application is a continuation-in-part application of application Ser. No. 761,860 filed Jan. 24, 1977 now U.S. Pat. No. 4,136,877 which, in turn, is a continuation-in-part application of application Ser. No. 646,897 filed Jan. 16, 1976, now abandoned.

BACKGROUND OF THE INVENTION

This invention relates to an improvement of the golf club alignment system shown in Ser. No. 761,860 filed Jan. 24, 1977. As described in detail in the previous application, misalignment of the golf club, particularly a putter, when attempting to roll a golf ball into the hole, causes the ball to be struck off-line or mis-hit to the degree that the club was misaligned. The alignment system of Ser. No. 761,860 provides a method for aligning the club properly using an inner indicia and a complementary outer indicia which, when in alignment, form an enlarged image creating a single, central reference point that the golfer views to position the clubhead properly.

SUMMARY OF THE INVENTION

The present invention relates to an improved structure of the golf club alignment system shown in Ser. No. 761,860 and includes a cavity formed into the clubhead. The bottom surface of the cavity has an inner indicia. The clubhead surface or the top of the walls of the cavity has the complementary outer indicia. The cavity permits at least four opposing alignment marks which form the inner indicia and four complementary alignment marks which form the outer indicia. Each inner and outer mark is located at a point ninety degrees from the other inner and outer marks and this indicia arrangement provides a balanced visual alignment with a single focal point. The cavity also acts as a shield to minimize glare during the alignment procedure.

In addition, a complete system of alignment indicia is described including intersecting inner indicia having four-point, three-point and two-point alignment. adjoining inner indicia having three-point and two-point alignment, non-touching inner indicia having four-point, three-point and two-point alignment and a combination of geometric marks which are complementary to and align with various other geometric designs in four-point, three-point and two-point alignment arrangements.

It is, therefore, an object of the present invention to provide an alignment system for golf club putters which would permit easy and accurate positioning of the golf club at the start of the golf stroke.

The subject invention and its unique alignment features can best be understood by referring to the following description thereof together with the reference to the accompanying drawings.

BRIEF DESCRIPTION OF THE DRAWINGS

FIG. 1 is a perspective view of a golf clubhead and alignment system of the present invention.

FIG. 2 is a top plan view of the embodiment shown in FIG. 1.

FIG. 3 is a perspective view showing another embodiment of the present invention.

FIG. 4 is a sectional view of the golf clubhead of FIG. 3 taken along lines 4—4.

FIG. 5 is a perspective view of an alternate embodiment of the present invention showing the alignment device in an exploded position.

FIG. 6 is a sectional view of the golf clubhead of FIG. 5 taken along lines 6—6.

FIG. 7 is a perspective view of the third embodiment of the present invention.

FIG. 8 is a top plan view of a cut-away fragmentary portion of the golf clubhead of FIG. 7.

FIG. 9 is a perspective view of a fourth embodiment of the present invention.

DESCRIPTION OF THE PREFERRED EMBODIMENTS

Figure 10:
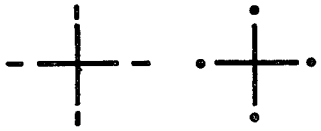
FIG. 10 illustrates a four-point alignment arrangement of intersecting inner indicia and complementary outer indicia.

FIGS. 1 and 2 illustrate a golf clubhead 10 formed with the alignment system of the present invention. The clubhead includes a ball striking face 12 which preferably is aligned with respect to loft and lie, prior to striking a ball toward the hole. The clubhead 10 is provided with a cavity 14 in its top. The bottom surface 16 of the cavity is provided with an inner image formed of loft alignment marks 18 and lie alignment marks 20. Complementary outer indicia, in the form of loft alignment marks 22 and lie alignment marks 24 are formed in the top surface of the clubhead adjacent the edges of the walls of the cavity.

In use, a golfer positions the clubhead so that the inner indicia marks 18 and 20 align with the complementary outer indicia marks 22 and 24 to form an enlarged image which is a single reference point which the golfer focuses on during the alignment procedure. For a more detailed description of the use and operation of the alignment system, reference is made to copending application Ser. No. 761,860 filed Jan. 24, 1977.

The use of a cavity located in the top of the clubhead permits the use of complementary outer indicia on all four sides of the cavity for alignment with the four alignment marks forming the inner indicia at the bottom surface 16 of the cavity 14. This creates a balanced visual arrangement of the indicia when viewed by a user of the club.

The cavity also acts as a shield to minimize glare which helps the user to quickly align the inner marks with the complementary outer marks.

FIGS. 3 and 4 illustrate another embodiment of the invention. A clubhead 30 includes a cavity 32, the bottom 34 of which is provided with an inner indicia which is formed of a loft alignment mark 36 and a lie alignment mark 38. The cavity 32 is provided with a shoulder 40 recessed from the top surface of the clubhead 30. The complementary outer indicia loft marks 42 and lie marks 44 are positioned on the shoulder 40 of the clubhead 46. The inner indicia and the complementary outer indicia are of the same type as shown in FIGS. 1 and 2 and are used in the same way.

FIGS. 5 and 6 illustrate another embodiment of the clubhead of the present invention similar to that shown in FIGS. 1 and 2 with the exception that the alignment system takes the form of an insert 50 which is a box-like structure including side walls 52 and a bottom 54 which fits into a cavity 56 in the clubhead 48. As in FIGS. 1 and 2, inner indicia 58 (partially shown) including the loft and lie alignment marks lies on the bottom surface 54 of the insert 50. The upper surface of the walls 52 of the insert 50 has the complementary outer indicia 62 including both loft and lie alignment marks which interface with the inner indicia 58 alignment marks when the clubhead is properly aligned.

FIGS. 7 and 8 illustrate another embodiment of the present invention wherein a golf clubhead 70 of the flange-type is shown having an alignment system formed of a box 72 including a bottom surface 74 which has the inner indicia 76 and side walls 78, the top surface of which has the complementary outer indicia 80.

FIG. 9 shows an embodiment of a center shafted blade putter head 90 including an alignment system of the present invention. The inner indicia 92 lie on the bottom surface 94 of a cavity 96 formed in the top of the putter head 90. The complementary outer indicia 98 lies adjacent the top surface of the cavity 96.

It will be appreciated that whereas the alignment system of the present invention can be made as an insert, or it can be made equally well by being cut-out or molded directly into the clubhead itself.

Figure 11:
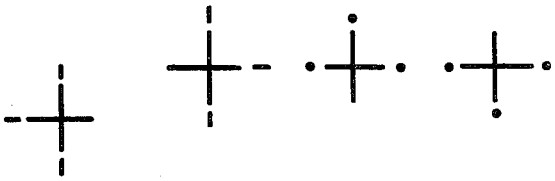
FIG. 11 is a view of intersecting inner indicia and complementary outer indicia in a three-point alignment arrangement.
Figure 12:
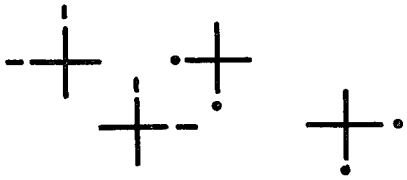
FIG. 12 is a view of intersecting inner indicia and complementary outer indicia in a two-point alignment arrangement.

FIGS. 10, 11 and 12 illustrate an alignment system in accordance with the present invention including inner indicia and aligning complementary outer indicia. The inner indicia configuration is shown where the inner indicia are intersecting; that is, wherein they cross each other to form a single image. FIG. 10 shows this arrangement in a four-point alignment, FIG. 11 shows the arrangement in a three-point alignment and FIG. 12 shows the arrangement in a two-point alignment.

It will be appreciated that the present invention works equally well with the two-point alignment as with the three-or four-point alignment.

Figure 13:
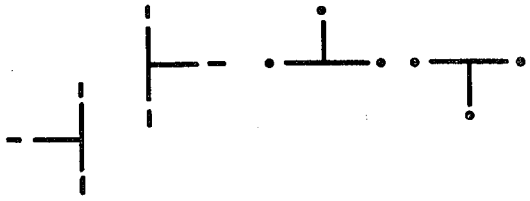
FIG. 13 is a view of adjoining inner indicia and complementary outer indicia in a three-point alignment arrangement.
Figure 14:
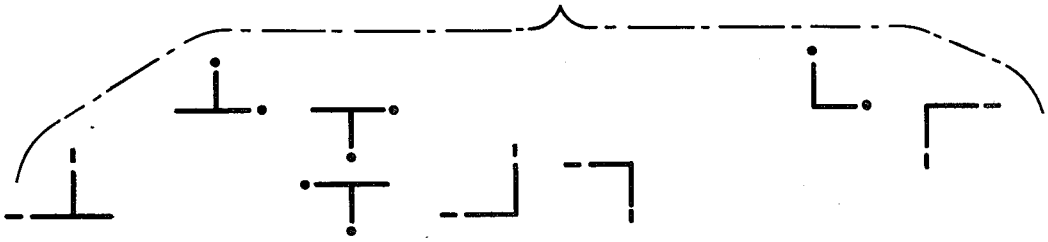
FIG. 14 is a view of adjoining inner indicia and complementary outer indicia in a two-point alignment arrangement.

FIGS. 13 and 14 show the inner indicia adjoining but not intersecting each other. FIG. 13 shows a three-point alignment arrangement using this type of inner indicia and FIG. 14 shows a two-point alignment arrangement using this type of inner indicia.

Figure 15:
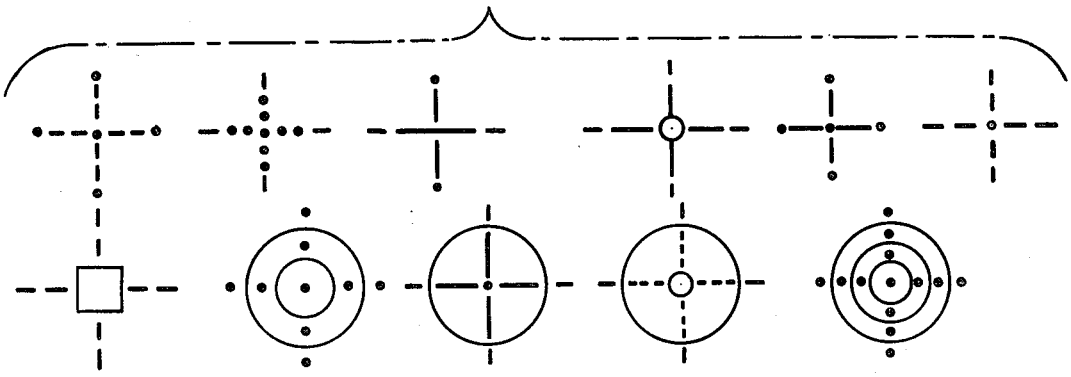
FIG. 15 is a view of non-touching inner indicia and complementary outer indicia in a four-point alignment arrangement.

FIG. 15 shows a number of types of non-touching inner indicia arranged in a four-point alignment manner with the complementary outer indicia.

Figure 16:
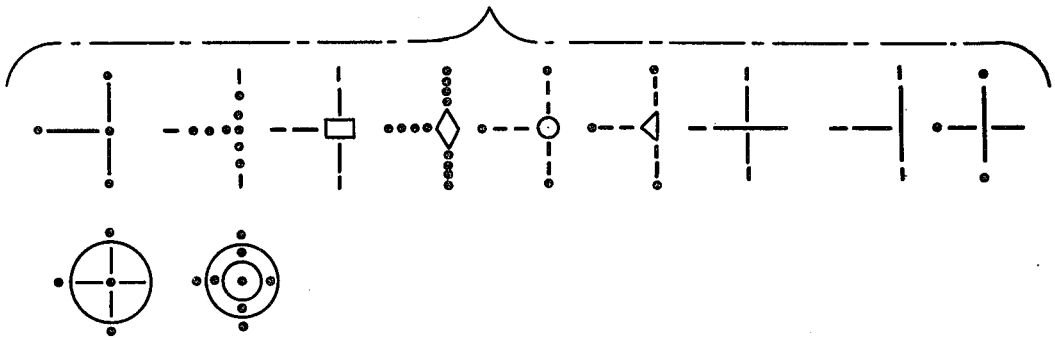
FIG. 16 is a view of non-touching inner indicia and complementary outer indicia in a three-point alignment arrangement.

FIG. 16 shows the same type of non-touching inner indicia in a three-point alignment arrangement.

Figure 17:
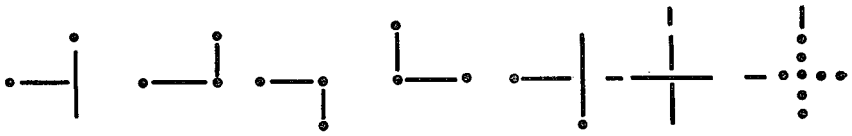
FIG. 17 is a view of non-touching inner indicia and complementary outer indicia in a two-point alignment arrangement.

FIG. 17 shows non-touching inner indicia in a two-point alignment arrangement.

Figure 18:
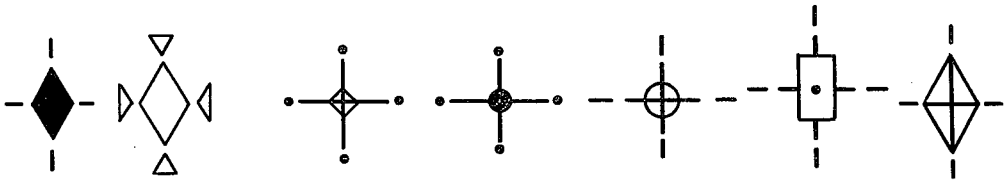
FIG. 18 is a view of a combination of geometric marks forming inner indicia and complementary outer indicia showing a four-point alignment arrangement.
Figure 19:
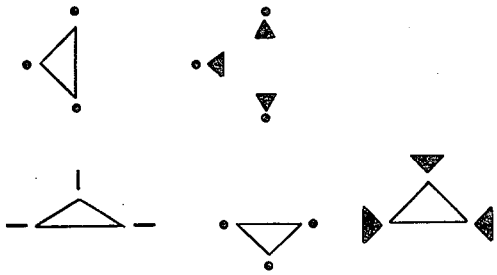
FIG. 19 is a combination of geometric marks forming inner indicia and complementary outer indicia in a three-point alignment arrangement.
Figure 20:
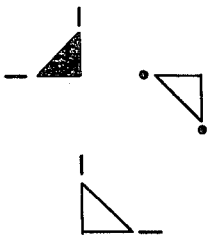
FIG. 20 is a view of a combination of geometric marks forming the inner indicia and complementary outer indicia in a two-point alignment arrangement.

FIGS. 18, 19 and 20 show various arrangements of inner geometric marks or designs which align with complementary outer indicia which may also be of geometric configurations. FIG. 17 shows a four-point alignment arrangement, FIG. 18 shows a three-point alignment arrangement, and FIG. 19 shows a two-point alignment arrangement using this combination of inner indicia formed of geometric marks.

It can be seen from the above that any arrangement or design of inner indicia may be used with any other arrangement or design of complementary outer indicia to form an alignment system for positioning a golf club correctly with respect to both loft and lie alignment as long as there is a vertical spacing between the inner indicia and the complementary outer indicia. Furthermore, the inner indicia may be of a higher level or at a lower level on the golf club with respect to the complementary outer indicia.

It will be appreciated that many modifications may be made to the present invention without departing from the scope of the appended claims.

What is claimed is:

1. An alignment system for a golf club to enable a user to establish precision alignment for both lie and loft indicating when the club head is properly soled, said golf club having a frontal ball striking face and upper and lower surfaces comprising:

inner indicia located on one of said surfaces forming a dominant central image having at least two inner directional marks, at least one of said marks extending on a line parallel to said striking face and at least a second of said marks extending on a line perpendicular to said striking face; and outer indicia positioned outside of said inner indicia and located on the other of said surfaces, vertically spaced from said inner indicia, said outer indicia having at least one outer directional mark in the same linear direction as each of said inner directional marks, one of said outer marks being parallel to said striking face and a second of said outer marks being perpendicular to said striking face, said outer indicia being complementary to said inner indicia creating a visual, in-line, outwardly radiating extension of said inner indicia whereby said dominant central image appears as one enlarged image when the club head is properly aligned.

2. The alignment system of claim 1 wherein said inner indicia is formed of a series of outwardly radiating non-touching marks.

3. The alignment system of claim 1 wherein said inner directional marks radiate outwardly in three directions.

4. The alignment system of claim 1 wherein said inner directional marks radiate outwardly in four directions.

5. The alignment system of claim 1 wherein said inner indicia is formed of a geometric pattern having at least two points complementary to said outer indicia.

* * * * *